United States Patent [19]

Brouwer

[11] 4,353,312

[45] Oct. 12, 1982

[54] BOTTOM DISCHARGE HOPPER RAIL CAR

[75] Inventor: Cornelis Brouwer, Potchefstroom, South Africa

[73] Assignee: Rotaque (Proprietary) Limited, Transvaal Province, South Africa

[21] Appl. No.: 123,588

[22] Filed: Feb. 22, 1980

[51] Int. Cl.[3] ..... B65G 67/24

[52] U.S. Cl. ..... 105/241.2; 105/250; 105/247; 414/338

[58] Field of Search ..... 105/247, 404, 406, 416, 105/418, 420, 424, 242.2, 250, 283, 251, 241.1, 241.2; 414/338

[56] References Cited

U.S. PATENT DOCUMENTS

| | | | |
|---|---|---|---|
| 1,594,863 | 8/1926 | Warner | 105/241.2 |
| 1,830,390 | 11/1931 | Flowers | 105/279 |
| 4,046,268 | 9/1977 | Adler | 106/241.2 |

*Primary Examiner*—Richard A. Bertsch
*Attorney, Agent, or Firm*—Ladas & Parry

[57] ABSTRACT

A bottom discharge hopper rail car has a hopper body mounted on a chassis which is itself supported on flanged wheels. The body has a pair of downwardly converging, laterally spaced side walls with longitudinally extending lower edges which border a discharge opening. The spacing between the lower edges of the sidewalls is greater than the lateral distance between the wheels as wider openings can facilitate discharge. In practice, the wheels have outer flange surfaces adjacent to rail-engaging surfaces for resting on the rails, and the spacing between the lower edges of the side walls is preferably greater than the distance between these outer flange surfaces. The side walls are asymmetrical with respect to a longitudinal vertical plane passing centrally between the wheels as this can inhibit bridging during discharge. A door is pivotally mounted on the body and displaceable between a position in which it closes said opening and a position in which it is spaced from said opening to permit discharge of the contents of said body.

14 Claims, 2 Drawing Figures

BOTTOM DISCHARGE HOPPER RAIL CAR

This invention relates to bottom discharge hoppers and, in particular, to hoppers which are an improved form of the hopper disclosed in South African Patent Specification No. 77/2681 (corresponding to co-pending U.S. Ser. No. 902,319).

Because of the problems arising from the discharging of moist or sludge-like materials from hoppers having a plurality of relatively narrow openings, there has been a tendency to use hoppers with single openings in some fields. Furthermore, recent trends have indicated that single-door hoppers are preferred in several cases in view of their definite advantages. However, prior art hoppers known to the applicant have not completely solved the problems involved in spite of the tremendous development work in this field.

In South African Specification No. 77/2681, there is disclosed a single-door bottom discharge hopper rail car having laterally spaced downwardly converging side walls with longitudinally extending lower edges defining a discharge opening from the body. The hopper has a door which is displaceable between a position in which it closes the opening and a position in which it is spaced from the opening to permit discharge of the contents of the body. The earlier specification discloses the advantageous feature of providing side walls at different angles in order to inhibit bridging of materials in the hopper. In practice, it has been found that this arrangement allows material initially to slide down the steeper wall. However, the width of the opening has always had to be less than the distance between the wheels because material must fall between the rails in such bottom discharge hoppers. Clearly, material falling on the axle boxes of the hopper rail car, is undesirable and can cause considerable damage.

In spite of the considerable improvements provided in the hopper of South African Specification No. 77/2681, it was found that bridging could still occur, particularly with thick sludges and that the angle of the steeper of the asymmetrical side walls could not be great enough for some purposes because of the limitations of the width of the opening.

The applicant therefore re-appraised the problems involved and has now provided a modified hopper incorporating the advantages of the hopper in South African Specification No. 77/2618 but further reducing the likelihood of bridging and facilitating the speed of discharge.

The present invention provides a bottom discharge hopper rail car comprising a hopper body mounted on a chassis which is itself supported on flanged wheels, the body having a pair of downwardly converging, laterally spaced side walls with longitudinally extending lower edges which border a discharge opening from the body; and a swinging door pivotally mounted on the body and displaceable between a position in which it is located below and closes said opening and a position in which it is to one side of said opening to permit discharge of the contents of said body; wherein the side walls are asymmetrical with respect to a longitudinal vertical plane passing centrally between the wheels, and wherein the lower edges of the side walls are at a greater lateral distance apart than the wheels.

The wheels may have outer flange surfaces adjacent to rail-engaging surfaces for resting on the rails, and, in order to be of value in practice, the spacing between the lower edges of the side walls should be greater than the distance between these outer flange surfaces. As the spacing increases, the probability of bridging can be reduced, but the necessary hopper rigidity must, of course, be retained. Thus, the spacing is preferably at least as great as the distance between the inner flange surface of one wheel and the outer edge of the rail-engaging surface of the other wheel. The lower edges may then be offset from one another in the vertical direction and may be asymmetrical with respect to a central vertical plane between the wheels in the horizontal direction. For example, one lower edge may be substantially level with the flanges of the wheels on the respective side of the hopper, and the other lower edge may be substantially level with the outer edges of the rail-engaging surfaces of the other wheels. This has the tremendous advantage that it enables the wall above said other lower edge to be relatively steep in order further to enhance discharge from the hopper without significantly diminishing the volume of the hopper. For example, the coverging side wall above that edge may be at an angle of more than 50°, and preferably from 60° to 70° to the horizontal. An upright wall may extend upwardly from the top of this wall. The other side of the hopper may have an upright wall spaced from the respective inclined wall by an intermediate inclined wall so that this side is of progressively decreasing slope as it approaches the opening.

In practice, the material from the hopper must normally be discharged between the rails on which the hopper travels, and for this purpose inclined skirts may be provided to form a chute for guiding the material between the rails. The skirts may converge to such an extent that the distance between their lower edges is substantially equal to the lateral distance between the wheels so that the skirts do not unduly inhibit free flow of the material. Although the opening between the lower edges of the skirts is thus not significantly greater than the normal hopper discharge opening, it will be realised that the material being discharged from the hopper has already gathered momentum by the time it reaches this restriction and bridging is unlikely.

For a better understanding of the present invention, reference will now be made, by way of example, to the accompanying drawings, in which.

Figure 1:
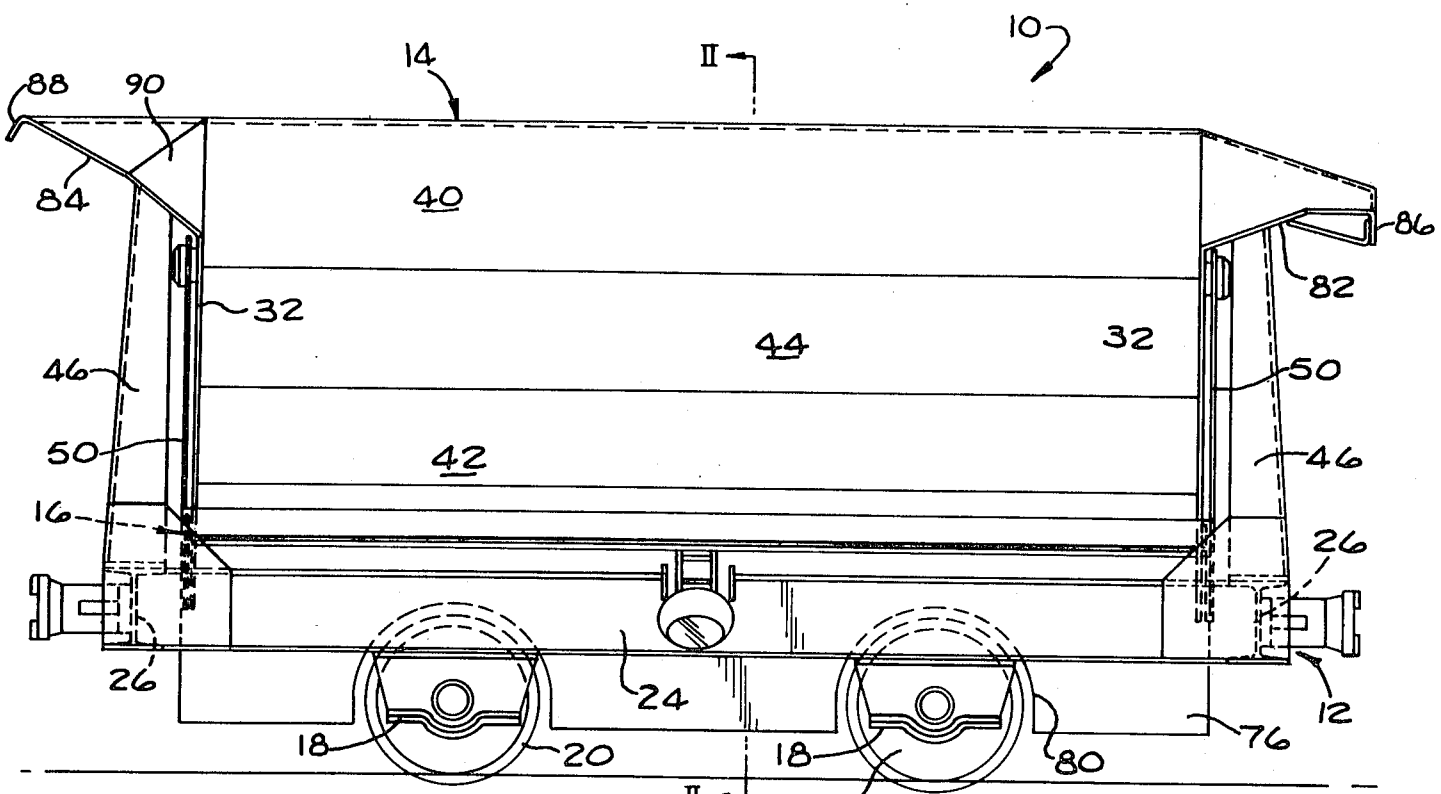
FIG. 1 is a side elevation of a bottom discharge hopper car.
Figure 2:
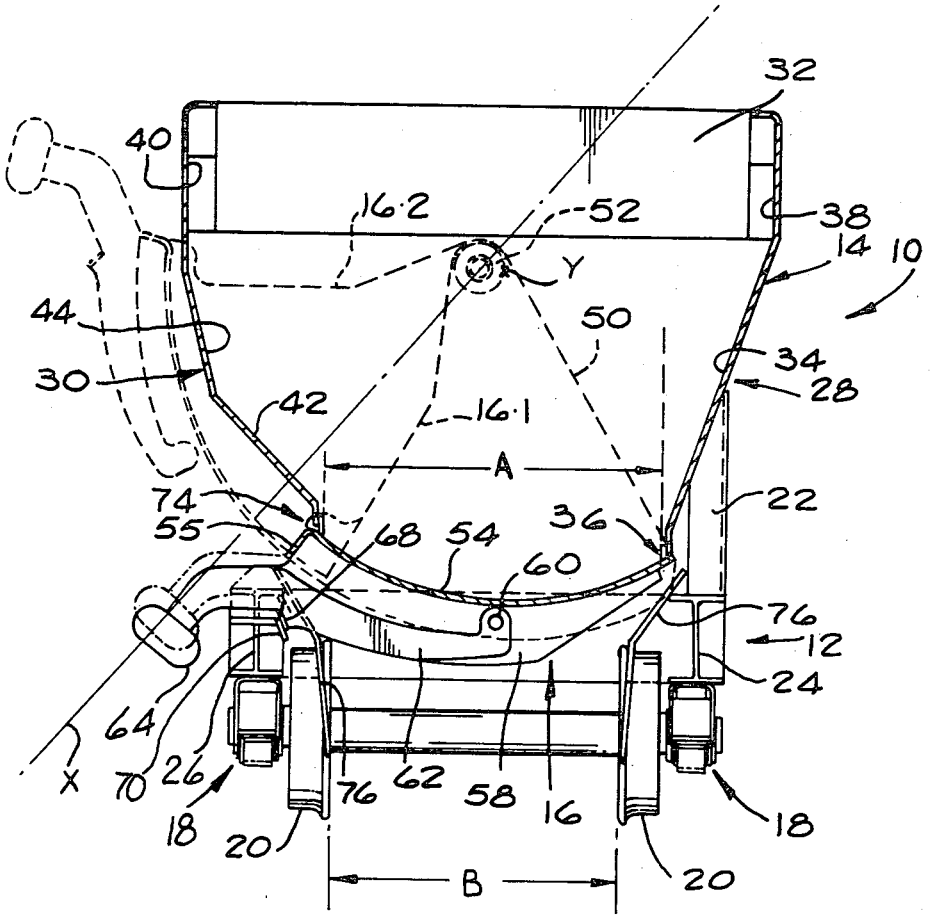
FIG. 2 is a sectional end elevation of the hopper car of FIG. 1.

The hopper car illustrated in FIGS. 1 and 2 is generally referenced 10 and comprises a chassis 12, a hopper body 14, and a door 16.

The chassis 12 includes two sets of wheel bearings 18 which mount flanged wheels 20 having rail-engaging surfaces laterally outwardly of their flanges. A series of supports 22 extend upwardly from a frame which forms a major part of the chassis 12 and which is itself constituted by a longitudinal beam 24 and longitudinal and transverse I-beams 26. The supports 22 are welded to the longitudinal beam 24.

The body 14 comprises laterally spaced sidewalls 28 and 30 fixed on the chassis 12, and two end walls 32. The sidewall 28 comprises a sloping wall 34 sloping upwardly from a lower longitudinal edge 36 and a vertical wall 38 extending upwardly from the sloping wall 34. The sidewall 30 has a vertical wall 40 which is parallel to, and spaced laterally from, the vertical wall 38, a further sloping wall 42, and an intermediate wall 44 which is between the walls 40 and 42 and is inclined at a relatively steep angle compared to the wall 42. The walls can be strengthened by suitable stiffeners, where necessary.

As will be clearly understood from the following description, the door 16 swings between the positions illustrated at 16.1 and 16.2 in FIG. 2. To permit this movement to take place, while still providing some support for the hopper body on this side of the car, two vertically elongated supports 46 of I-section are provided. The supports 46 extend between the transverse I-beams 26 of the frame 14 and are secured to the walls 32.

The door 16 comprises two approximately triangular end plates 50 which are carried pendulum fashion by overhead pivot structures 52. The overhead pivot structures 52 mount the end plates 50 on the end walls 32 of the hopper body 14.

The door 16 further includes a curved base plate 54 (the concave face of the base plate being uppermost) which extends between and is secured to the end plates 50. The base plate 54 is strengthened by a pair of channels 56 which extend downwardly from the underside thereof. One of the longitudinal edges 55 of the base plate 54 is turned downwardly which also enhances its strength.

Centrally of the door, i.e. midway between the plates 50, the door is provided with two curved, parallel, transversely extending stiffeners 58. A pivot pin 60 is mounted on the stiffeners 58 and the pin 60 pivotally mounts an arm 62. The arm has a roller 64 rotatably mounted at the outer end thereof.

The upper face of the arm 62 is shown at 66 and it will be seen that this, in the closed position of the door, is spaced from the turned-down longitudinal edge 55 which lies thereabove. The lower side of the edge 55 constitutes an abutment surface of the door and the co-operating portion of the arm constitutes an abutment face on the arm. When the outer end of the arm 62 is lifted upon the roller 64 encountering a ramp there is some lost motion between the arm 62 and the door 16. More specifically, the arm 62 lifts, pivoting about the pin 60 with respect to the door 16, until the gap between this turned-down edge 55 and the arm has been taken up. Thereafter, further swinging movement of the arm 62 in an upward direction towards the position 16.2 shown in FIG. 2 causes the door 16 to lift. It will be noted that in this position the arm 62 is in engagement with the turned-down edge 55. Discharge of the material in the hopper body then takes place, the material sliding downwardly over the walls 34 and 42 and through the rectangular frame constituted by the channel 24 and I-beams 26.

The arm 62 has a stepped undersurface provided with a wedge plate 68 for engaging a complementary wedge plate 70 on the I-beam 26 in the closed condition of the door.

As will be seen from FIG. 2, the wedge plate 68 engages the wedge plate 70 of the longitudinal I-beam 26 so that, in the closed condition of the door, lateral movement of the arm and door towards the open position is prevented. During the upward lost motion of the arm 62 with respect to the base plate 54, the wedge plate 68 clears the wedge plate 70. Consequently, by the time the arm engages and commences to lift the door in its outward swinging movement, the wedge plates are clear of one another and as a consequence, do not hinder such movement.

During the closing movement of the door, the door and arm swing downwardly together until the door reaches its fully closed position. Thereafter the arm moves downwardly away from the door and the wedge plates re-engage. Downward movement of the arm 62 ceases when the wedge plates are located firmly against one another.

The axis of rotation of the roller 64 in its initial door pivoting position, is shown at X in FIG. 2 and it will be seen that this passes through the common axis of the pivot structures 52. It naturally continues to pass through this axis as the door pivots. The curved base plate 54 of the door 16 is generated about a longitudinal axis Y slightly to the right of the common axis of the pivot structures 52 in FIG. 2.

By off-setting the axis Y horizontally from the common axis of the pivot structures 52, the motion imparted to the door 16, while being a true pendulum motion, includes a downward component with respect to the stationary parts of the hopper. This means that those portions of the door which are in sealing engagement with the lower edges of the walls 34 and 42 of the hopper body do not simply swing laterally with respect thereto. Instead, said portions simultaneously swing laterally and move downwardly with respect to said stationary parts so that gaps of progressively increasing width are created. This can thus reduce the possibility of ore wedging the door solidly to the body and can thereby help to prevent the car being tipped over by the ramp.

The sloping walls 34 and 42 are asymmetrically arranged with respect to one another insofar as their angles of slope are concerned and/or insofar as the disposition of their upper and lower edges in the horizontal plane is concerned. More specifically, the two walls slope at different angles and the horizontal plane containing the convergence between the walls 34 and 38 is at a different vertical level to the horizontal plane containing the convergence between the walls 40 and 44 or 42 and 44. The side wall 34 is at a relatively steep angle of about 70° to the horizontal. The lower edges of the walls 42 and 34 are in a different plane. By means of this asymmetrical arrangement of the walls, it is possible to reduce the tendency of material contained in the hopper body to 'bridge' when efforts are made to discharge it, as compared with many alternative hoppers.

The lower edge 36 of the inclined sidewall 34 and the lower edge 74 of the inclined sidewall 42 are spaced apart at a distance A which is greater than the distance B between the wheels 20. The distance A is, in fact, about equal to the distance between the outer edge of the rail-engaging surface of one wheel and the outer edge of the flange of the other wheel on the same axle. The provision of the wide opening in combination with the steep side wall 34 can further help to ensure that the material in the hopper, particularly muddy material, will not form a bridge over the hopper opening when the door opens, as can often happen with many conventional hoppers.

In order to ensure that material passing through the hopper opening is inhibited from falling outside the rails on which the hopper runs, inclined skirt plates 76 are provided to form a chute for guiding material falling from the hopper between the rails. The skirt plates have laterally outer parts converging from locations outwardly of the opening substantially to the planes of the wheel flanges. The plates also have relatively steep inner parts converging to a gap of width B, which is equal to the distance between the wheels. Although the skirt plates are much closer together in the region of the gap than are the sidewalls 34 and 42, material falling from the hopper does not form a bridge over the space between the skirt plates in this region because the material has already developed sufficient momentum to prevent this by the time it reaches the skirt plates.

The skirt plates are cut away or modified to provide clearance for the wheels of the vehicle and the wheel arches thus formed can be strengthened by welding on arched elements in the region 80.

As will be seen from FIG. 1, the upper ends of the end walls 32 of the hopper body 14 may be provided with diverging guide walls 82 and 84 which constitute overhanging portions of the body. The guide wall 82 slopes at an angle of less than 45 degrees and terminates in a downwardly directed lip 86. The wall 84 slopes at about 45 degrees and also terminates in a lip 88. The walls 82 and 84 are such that, when two hopper cars are coupled end-to-end in a train, the wall 84 and its lip 88 overhang the wall 82 and its lip 86. Thus, when the car is filled while moving under a continuous discharge or ore or the like, the overhanging walls 82 and 84 ensure that material cannot be dumped between the cars onto the track.

When the hopper cars negotiate a bend in the track, the laterally outer ends of the wall 82 move one forwardly and one rearwardly with respect to the overhanging wall 84. To prevent engagement of the wall 82 with the wall 84, the end portions of the wall 84 are formed with vee-shaped notches 90. With this arrangement the ends of the wall 82 swing into these notches so that the train can round the bend safely without any of the trucks being derailed.

I claim:

1. A bottom discharge hopper structure comprising:

a chassis which is supported on flanged wheels having rail-engaging surfaces for resting on spaced rails, a hopper body mounted on the chassis and having a longitudinal central vertical plane, the hopper body comprising two longitudinally extending side walls and two transverse end walls, each side wall comprising at least a sloping wall which slopes inwardly towards the longitudinal central plane of the hopper body, one of said sloping wall being at a lesser angle to the vertical than the other of said sloping walls, and said sloping walls having lower edges bordering a bottom opening which has a width greater than the distance between said wheels, a single door mounted for swinging movement between a position in which it closes said opening and a position in which it is offset with respect to said opening to permit discharge from the hopper body, and chute plates converging downwardly away from said opening, the chute plates each extending from a position which is located outwardly of a lower edge of a respective side wall to a position which is located inwardly of the rail-engaging surfaces of the wheels for guiding material being discharged from said hopper body between rails on which the wheels rest.

2. A hopper structure according to claim 1, wherein the wheels have outer flange surfaces adjacent to said rail-engaging surfaces, and the lateral distance between the lower edges of the side walls is greater than the distance between these outer flange surfaces.

3. A hopper structure according to claim 2, wherein the said lateral distance is greater than the distance between the inner flange surface of one wheel and the outer edge of the rail-engaging surface of the other wheel.

4. A hopper structure according to claim 3, wherein the lower edges of the sidewalls are offset from one another in the vertical direction and are asymmetrical with respect to the central vertical plane between the wheels in the horizontal direction.

5. A hopper structure according to claim 4, wherein one lower edge is substantially directly above an outer edge of the rail-engaging surface of one of the wheels.

6. A hopper structure according to claim 3, wherein said one sloping wall is at an angle of more than 50° to the horizontal.

7. A hopper structure according to claim 6, wherein an upright wall extends upwardly from the top of said one sloping wall.

8. A hopper structure according to claim 3, wherein the door is provided with a tipping arm which carries a roller for engaging a cam track as the vehicle moves past the cam track, the roller having an axis of rotation substantially radial to a pivot axis for the door so that the cam track can be profiled in such a way that, as the door opens, pivoting force exerted by the cam track on said roller to open the door, is substantially tangential to an arc described by the arm and the door about the pivot axis of the door.

9. A hopper structure according to claim 8, wherein the door comprises two end plates which hang from pivot structures and an elongated plate of arcuate cross section which joins said end plates, the elongated plate being sufficiently wide to close said discharge opening and being generated about an axis offset with respect to the axis of the pivot structures of the door in such a manner that said elongated plate moves both downwardly and laterally with respect to the lower edges of the side walls, thereby to cause a gap of progressively increasing width to be created between said door and said lower edges during opening.

10. A hopper structure according to claim 1, wherein the chute plates have lower parts with lower edges and the lower parts converge to such an extent that the distance between their lower edges is less than the distance between the rail-engaging surfaces.

11. A hopper structure according to claim 1, wherein the chute plates have lower parts formed by skirts having lower edges and wherein the distance between the lower edges of these skirts is substantially equal to the lateral distance between the wheels.

12. A hopper structure according to claim 1, wherein the distance between the lower edges of the converging side walls is greater than the distance between the rail-engaging surfaces.

13. A hopper structure according to claim 12, wherein the lower edges of the side walls are offset from one another in the vertical direction and are asymmetrical with respect to the central vertical plan between the wheels in the horizontal direction.

14. A hopper structure according to claim 1, wherein the lower edge of said one sloping wall is beneath the horizontal level of the lower edge of said other sloping wall.

* * * * *